US006129081A

United States Patent [19]

Wu

[11] Patent Number: 6,129,081

[45] Date of Patent: Oct. 10, 2000

[54] STRUCTURE OF SNORKEL

[76] Inventor: Alice Wu, 128 Chung-Hsing Rd. Sec.2, Wu-Ku Hsiang,Taipei Hsien, Taiwan

[21] Appl. No.: 09/193,417

[22] Filed: Nov. 18, 1998

[51] Int. Cl.[7] ..... B63C 11/16

[52] U.S. Cl. ..... 128/201.11; 128/201.28

[58] Field of Search ..... 128/201.11, 201.27, 128/201.26, 206.29, 201.28, 201.29, 200.29

[56] References Cited

U.S. PATENT DOCUMENTS

| | | | |
|---|---|---|---|
| 1,946,126 | 2/1934 | Black | 128/201.11 |
| 3,082,766 | 3/1963 | Taylor | 128/201.11 |
| 3,908,647 | 9/1975 | Taunton | 128/201.11 |
| 4,278,080 | 7/1981 | Schuch | 128/201.11 |
| 4,834,084 | 5/1989 | Walsh | 128/201.11 |
| 4,860,739 | 8/1989 | Vandepol | 128/201.11 |
| 4,872,453 | 10/1989 | Christianson | 128/201.11 |
| 4,884,564 | 12/1989 | Lamont | 128/201.11 |
| 5,092,324 | 3/1992 | Christianson | 128/201.11 |
| 5,143,059 | 9/1992 | Delphia | 128/201.11 |
| 5,267,556 | 12/1993 | Feng | 128/201.11 |
| 5,280,785 | 1/1994 | Fujima | 128/201.11 |
| 5,529,057 | 6/1996 | Ferrero et al. | 128/201.11 |
| 5,606,967 | 3/1997 | Wang | 128/201.11 |
| 5,845,635 | 12/1998 | Hermansen et al. | 128/201.11 |

*Primary Examiner*—John G. Weiss
*Assistant Examiner*—Teena Mitchell
*Attorney, Agent, or Firm*—Bacon & Thomas

[57] ABSTRACT

A snorkel includes a rigid main tube, a Y-branch connected to the bottom end of the main tube by a flexible tube to hold a mouthpiece, wherein the main tube has a filter at a curved top end thereof, a side chamber with a downward outlet, a check valve in the downward outlet for letting air/water out, and a baffle suspended on the inside and sloping toward the side chamber to guide a part of the user's exhaled air toward the check valve in the downward outlet of the side chamber; the Y-branch has a check valve at a bottom end thereof for letting air/water out, and a baffle suspended on the inside and spaced between the mouthpiece and the check valve of the Y-branch to guide a part of the user's exhaled air toward the check valve of the Y-branch.

1 Claim, 2 Drawing Sheets

STRUCTURE OF SNORKEL

BACKGROUND OF THE INVENTION

The present invention relates to a snorkel for skin diving, and more particularly to such a snorkel which has means to guide exhaled air in expelling permeated water to the outside efficiently.

The game of skin diving (breathhold diving) is one of the most popularly invited water sports activities. When playing the game of skin diving (breathhold diving), a snorkel must be used. A regular snorkel is generally comprised of a rigid main tube, a bend connected to one end namely the bottom end of the main tube, a mouthpiece mounted on the bend, and a hook mounted on the main tube for securing to the strap of for example the face mask. The bend has an exhaust hole on the middle at the bottom side, and a check valve mounted in the exhaust hole for letting air/water out. The top end of the main tube is maintained above the level of the water so that the user can breathe smoothly when diving. When diving, sea water may be carried with water waves into the main tube and then accumulated in the bend. When sea water gets into the main tube, it must be forced out of the snorkel. However, because permeated sea water is accumulated in the bend, it is difficult to force accumulated sea water out of the check valve by exhaled air. When the user exhales, most air pressure is guided toward the main tube, i.e., little air pressure is applied to accumulated sea water against the check valve. Furthermore, because the top end of the main tube is an open end having no shielding means, sea water tends to be carried with sea waves into the main tube.

SUMMARY OF THE INVENTION

The present invention provides a snorkel which eliminates the aforesaid drawbacks. It is one object of the present invention to provide a snorkel which has means to guide exhaled air in forcing accumulated sea water to the outside. It is another object of the present invention to provide a snorkel which enables permeated sea water to be forced to the outside by exhaled air evenly in three directions. It is still another object of the present invention to provide a snorkel which effectively prevents sea water from passing to the inside of the main tube in a rush. To achieve these and other objects of the present invention, there is provided a snorkel comprised of a rigid main tube having a top end and a bottom end, a flexible tube having a bottom end connected to the bottom end of the main tube and a bottom end, a Y-branch having a first top end connected to the bottom end of the flexible tube, a second top end and a bottom end, a mouthpiece mounted on the second top end of the Y-branch, and a hook mounted on the main tube for fastening, wherein the main tube comprises a filter at the top end thereof, a side chamber having a downward outlet, a check valve mounted in the downward outlet for letting air/water out, and a baffle suspended on the inside and sloping toward the side chamber to guide a part of the user's exhaled air toward the check valve in the downward outlet of the side chamber; the Y-branch comprises a check valve mounted in the bottom end thereof for letting air/water out, and a baffle suspended on the inside and spaced between the mouthpiece and the check valve of the Y-branch to guide a part of the user's exhaled air toward the check valve of the Y-branch.

DETAILED DESCRIPTION OF THE PREFERRED EMBODIMENT

Figure 1:
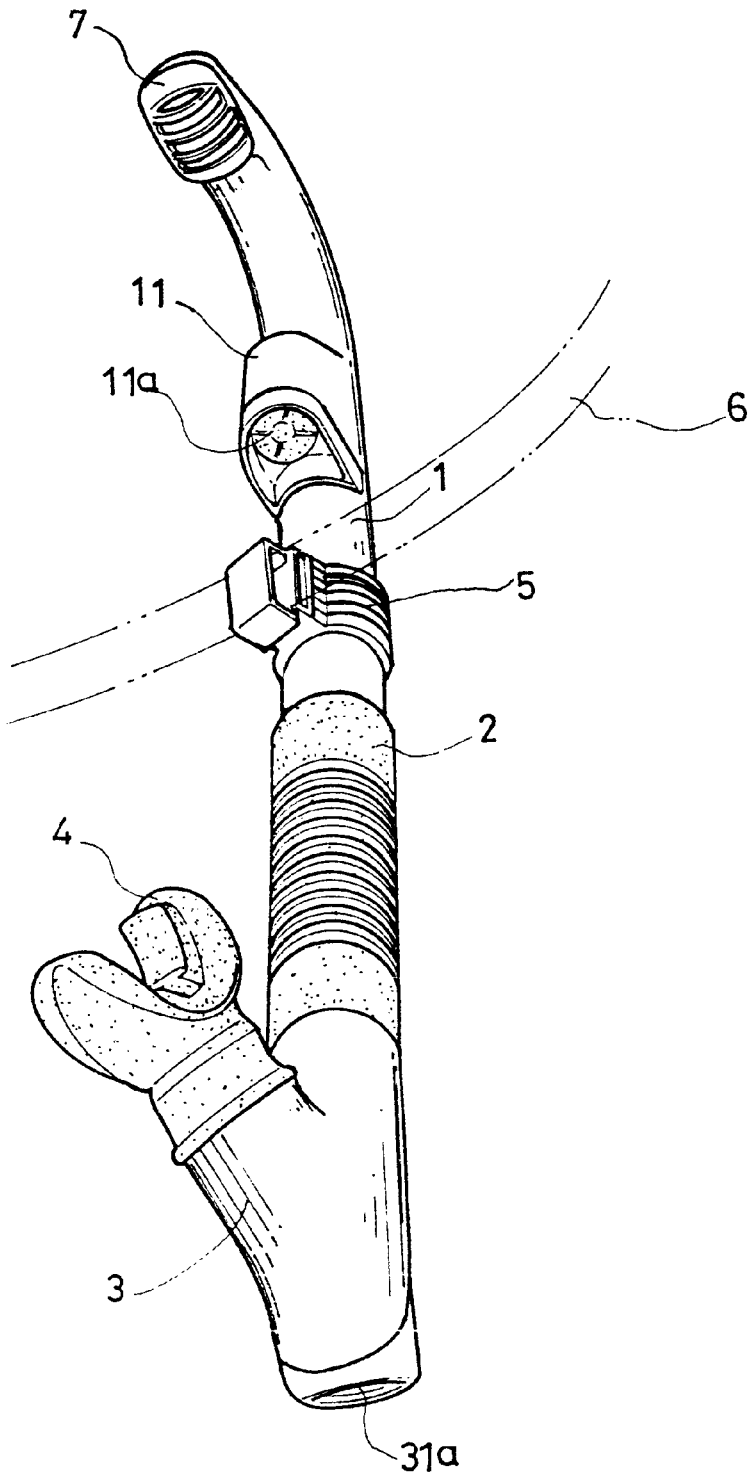
FIG. 1 is a perspective view of a snorkel according to the present invention.
Figure 2:
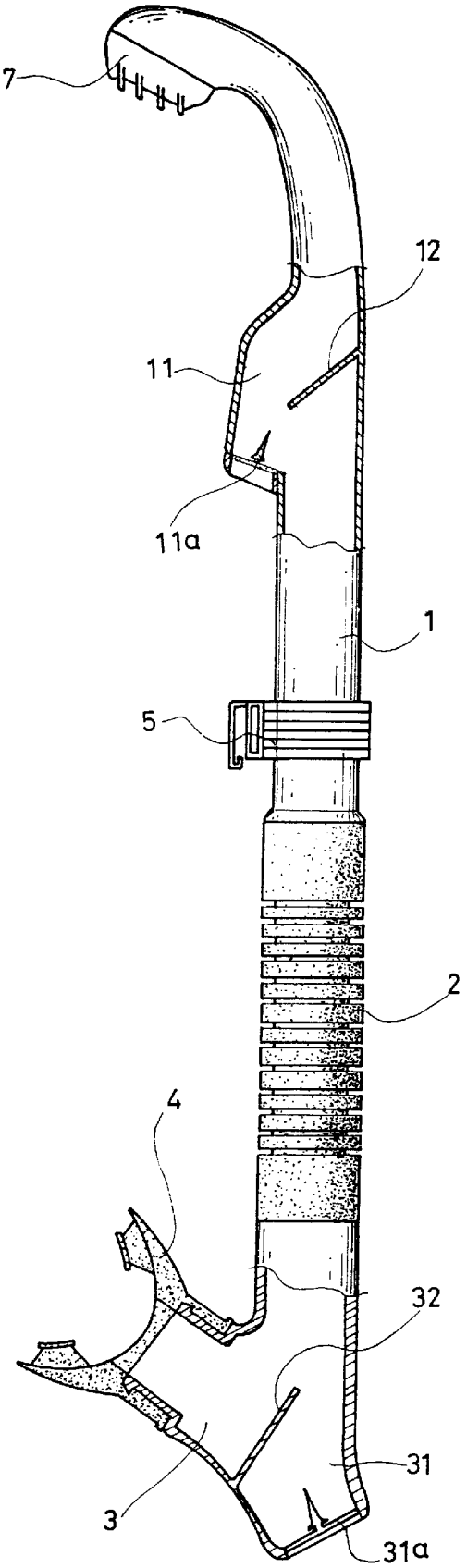
FIG. 2 is a sectional view of the snorkel shown in FIG. 1.

Referring to FIGS. 1 and 2, a snorkel in accordance with the present invention is generally comprised of a rigid main tube 1, a flexible tube 2 longitudinally and axially extended from one end, namely, the bottom end of the main tube 1, a Y-branch 3 extended from one end, namely, the bottom end of the flexible tube 2 remote from the main tube 1, a mouthpiece 4 connected to an outlet of the Y-branch 3 and a hook 5 mounted on the main tube 1 for securing to the strap 6 of a face mask (not shown).

Referring to FIGS. 1 and 2 again, the main tube 1 has a bottom end connected to the flexible tube 2, and a top end smoothly curved downwards and mounted with a filter 7. A downwardly extended cylindrical side chamber 11 is integral with the main tube 1 at one side, and having a top end in communication with the inside space of the main tube 1 and a bottom end mounted with a check valve 11*a*. A first baffle 12 is suspended inside the main tube 1 adjacent to the side chamber 11. The Y-branch 3 has two top ends respectively connected to the flexible tube 2 and the mouthpiece 4, and a bottom end 31 mounted with a check valve 31*a*. Bottom end 31 is positioned substantially along the longitudinal axis of main tube 1 and flexible tube 2. A second baffle 32 extends upwardly and obliquely in the Y-branch 3 between the mouthpiece 4 and the check valve 31*a*.

As indicated above, the top end of the main tube 1 is smoothly curved downwards and mounted with a filter 7. This design prevents sea water from passing to the inside of the main tube 1 easily. In case a small amount of sea water passes to the inside of the main tube 1 during skin diving, it is guided by the first baffle 12 toward the check valve 11*a*, and then forced out of the side chamber 11 through the check valve 11*a* by exhaled air. Further, because the second baffle 32 extends upwardly and obliquely in the Y-branch 3 between the mouthpiece 4 and the check valve 31*a*, a part of the exhaled flow of air is guided upwards by the second baffle 32, and the other part of the exhaled flow of air is forced toward the check valve 31*a*, enabling accumulated sea water to pass out of the snorkel through the check valve 31*a* to the sea. The upward flow of air is guided by the first baffle 12 toward the check valve 11*a*, causing accumulated sea water to be forced out of the side chamber 11 through the check valve 11*a* to the sea.

As indicated above, the baffles 12 and 32 distribute the exhaled flow of air out through three outlets and in three directions, enabling permeated sea water to be forced out of the snorkel through the filter 7, the check valve 11*a* at the side chamber 11, and the check valve 31*a* at the Y-branch 3. Because the Y-branch 3 is connected to the main tube 1 by the flexible tube 2, the mouthpiece 4 can be turned with the Y-branch 3 to the desired angle to eliminate the change of permeation of sea water into the main tube 1 during skin diving.

While only one embodiment of the present invention has been shown and described, it will be understood that various modifications and changes could be made thereunto without departing from the spirit and scope of the invention as disclosed herein.

What is claimed is:

1. A snorkel comprising a rigid main tube having a top end and a bottom end, a flexible tube having a top end connected longitudinally to the bottom end of said main tube and a bottom end, a Y-branch having a first top end connected to the bottom end of said flexible tube, a second top end and a bottom end, a mouthpiece mounted on the second top end of said Y-branch, and a hook mounted on said main tube for fastening, said main tube comprises a filter at the top end thereof, a side chamber spaced from the top end of the main tube and having a downwardly directed outlet, a check valve mounted in said downwardly directed outlet for letting air/water out, and a first baffle suspended on the inside and sloping downwardly toward said side chamber to guide a portion of exhaled air toward the check valve in said downward outlet of said side chamber; said Y-branch comprises a check valve mounted in the bottom end thereof for letting air/water out, the bottom end being positioned substantially along a longitudinal axis of the snorkel and a second baffle suspended on the inside and spaced between said mouthpiece ant eh check valve of said Y-branch to permit a portion of exhaled air to be directed toward the check valve of said Y-branch.

* * * * *